US009102905B2

(12) United States Patent
Walters et al.

(10) Patent No.: US 9,102,905 B2
(45) **Date of Patent: *Aug. 11, 2015**

(54) DETERGENT COMPOSITION COMPRISING ALKALI METAL HYDROXIDE AND METHODS OF MODIFYING A SURFACE

(71) Applicant: Ecolab USA Inc., St. Paul, MN (US)

(72) Inventors: Kerrie E. Walters, Minneapolis, MN (US); Monique Roerdink-Lander, Eagan, MN (US); Carter M. Silvernail, Burnsville, MN (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/444,630

(22) Filed: Jul. 28, 2014

(65) Prior Publication Data

US 2014/0336097 A1 Nov. 13, 2014

Related U.S. Application Data

(63) Continuation of application No. 13/786,760, filed on Mar. 6, 2013.

(60) Provisional application No. 61/718,753, filed on Oct. 26, 2012.

(51) Int. Cl.

| | |
|---|---|
| ***C11D 1/66*** | (2006.01) |
| ***C11D 7/36*** | (2006.01) |
| ***B08B 3/04*** | (2006.01) |
| ***C11D 3/37*** | (2006.01) |
| ***C11D 3/04*** | (2006.01) |
| ***C11D 11/00*** | (2006.01) |
| ***C11D 3/36*** | (2006.01) |

(52) U.S. Cl.

CPC *C11D 1/66* (2013.01); *C11D 3/044* (2013.01); *C11D 3/365* (2013.01); *C11D 3/3757* (2013.01); *C11D 3/3761* (2013.01); *C11D 3/3765* (2013.01); *C11D 3/3784* (2013.01); *C11D 11/0023* (2013.01)

(58) Field of Classification Search

CPC ..... C11D 1/66; C11D 3/044; C11D 3/3784; C11D 3/393; C11D 7/36; B08B 3/04

USPC ..... 510/225, 229, 252, 272, 360, 361, 445, 510/467, 475, 477; 134/25.2, 25.3, 39, 42; 8/137

See application file for complete search history.

(56) References Cited

U.S. PATENT DOCUMENTS

| | | | | |
|---|---|---|---|---|
| 6,489,287 | B1 | 12/2002 | Gauthier et al. | |
| 7,514,395 | B2 | 4/2009 | Bayersdoerfer et al. | |
| 7,790,664 | B2 | 9/2010 | Harrington et al. | |
| 8,481,473 | B2 * | 7/2013 | Silvernail et al. | 510/230 |
| 8,772,221 | B2 * | 7/2014 | Silvernail et al. | 510/451 |
| 2002/0069900 | A1 | 6/2002 | Evers | |
| 2009/0258810 | A1 | 10/2009 | Song et al. | |
| 2010/0323940 | A1 | 12/2010 | Lentsch et al. | |
| 2012/0329700 | A1 * | 12/2012 | Silvernail et al. | 510/451 |

FOREIGN PATENT DOCUMENTS

| | | |
|---|---|---|
| EP | 0322946 | 7/1989 |
| WO | 2011013070 | 2/2011 |

OTHER PUBLICATIONS

Ecolab USA Inc., et al., PCT/US2013/029381, "Notification of Transmittal of the International Search Report and the Written Opinion of the International Searching Authority, or the Declaration", mailed Jul. 18, 2013.

* cited by examiner

*Primary Examiner* — Brian P Mruk

(74) *Attorney, Agent, or Firm* — McKee, Voorhees & Sease, PLC

(57) ABSTRACT

An alkaline detergent is described which includes the use of polycarboxylic acid copolymers or salts thereof in combination with alkali metal hydroxide. The detergent composition reduces spotting and filming and prevents hard water scale accumulation between 145-180 degrees Fahrenheit and with a pH of 10.5 to about 13.

18 Claims, No Drawings

DETERGENT COMPOSITION COMPRISING ALKALI METAL HYDROXIDE AND METHODS OF MODIFYING A SURFACE

CROSS-REFERENCE TO RELATED APPLICATIONS

This application is a Continuation of application Ser. No. 13/786,760 filed Mar. 6, 2013, which claims priority under 35 U.S.C. §120 to Provisional Application Ser. No. 61/718,753 filed Oct. 26, 2012, herein incorporated by reference in its entirety.

TECHNICAL FIELD

The present invention is related to the field of alkaline detergent compositions. In particular, the present invention is related to an alkaline detergent composition including an alkali metal hydroxide and a polycarboxylic acid copolymer for superior cleaning performance and hard water scale control

BACKGROUND OF THE INVENTION

The level of hardness in water can have a deleterious effect in many cleaning applications. For example, when hard water alone, or in conjunction with cleaning compositions, contacts a surface, it can cause precipitation of hard water scale on the contacted surface. Scaling is the precipitation of a salt from solution that is supersaturated with respect to the salt. In general, hard water refers to water having a total level of calcium and magnesium ions in excess of about 100 ppm expressed in units of ppm calcium carbonate. Often, the molar ratio of calcium to magnesium in hard water is about 2:1 or about 3:1. The level of water hardness and ratio of calcium to magnesium are influenced by many factors such as geographic location, soil quality, pollutants and pH.

Hard water is also known to reduce the efficacy of conventional alkaline detergents used in the vehicle care, warewashing and laundry industries. One method for counteracting this includes adding chelating agents or sequestrants into detersive compositions that are intended to be mixed with hard water in an amount sufficient to handle the hardness. However, in many instances the water hardness exceeds the chelating capacity of the composition. As a result, free calcium ions may be available to cause precipitation, or to attack active components of the composition causing other deleterious effects, such as poor cleaning effectiveness or lime scale build up.

Alkaline detergents, particularly those intended for institutional and commercial use, generally contain phosphates, nitrilotriacetic acid (NTA) or ethylenediaminetetraacetic acid (EDTA) as a sequestering agent to sequester metal ions associated with hard water such as calcium, magnesium and iron and also to remove soils.

In particular, NTA, EDTA or polyphosphates such as sodium tripolyphosphate and their salts are used in detergents because of their ability to solubilize preexisting inorganic salts and/or soils. When calcium and/or magnesium salts precipitate, the crystals may attach to the surface being cleaned and cause undesirable effects. For example, calcium carbonate precipitation on the surface of ware can negatively impact the aesthetic appearance of the ware, giving an unclean look. The ability of NTA, EDTA and polyphosphates to remove metal ions facilitates the detergency of the solution by preventing hardness precipitation, assisting in soil removal and/or preventing soil redeposition during the wash process.

While effective, phosphates and NTA are subject to government regulations due to environmental and health concerns. Although EDTA is not currently regulated, it is believed that government regulations may be implemented in the future due to environmental persistence. There is therefore a need in the art for an alternative, and preferably environment friendly, cleaning composition that can reduce the content of phosphorous-containing compounds such as phosphates, phosphonates, phosphites, and phosphinates, as well as persistent aminocarboxylates such as NTA and EDTA.

Accordingly it is an object herein to provide an improved process for the prevention of scale in alkaline cleaning such as that used in ware washing, hard surface or CIP cleaning, car washing, instrument cleaning, boiler or cooling tower cleaning, laundry cleaning and the like.

It is another object to provide scale control compositions that may be used in conjunction with a cleaning composition for prevention of scale deposits not only on surfaces to be cleaned, but also on the cleaning machine components themselves.

Other objects, aspects and advantages of this invention will be apparent to one skilled in the art in view of the following disclosure, the drawings, and the appended claims.

SUMMARY OF THE INVENTION

The invention includes a detergent composition comprising an alkali metal hydroxide, a nonionic surfactant and a polycarboxylic acid copolymer. The detergent compositions of the invention reduce spotting, filming and prevent hard water scale accumulation between about pH 10.5 and 13 and between temperatures of 145°-180° F.

In aspects of the invention the detergent compositions are nitrilotriacetic acid (NTA)-free to meet certain regulations. In additional aspects of the invention the detergent compositions may be substantially phosphorous free to meet certain regulations. The polycarboxylic acid copolymers of the claimed invention may provide substantially phosphorous free detergent compositions having less than about 0.5 wt-% of phosphorus.

It is a benefit of the detergent compositions of the present invention to provide detergent compositions capable of controlling the redeposition of soils on a substrate surface (e.g. anti-redeposition). It is a further benefit of the solid detergent compositions of the present invention to control water hardness scale (e.g. calcium carbonate scale) in detergent applications. In particular, hardness scale is controlled without the use of phosphates, such as tripolyphosphates, commonly used in detergents to prevent hardness scale and/or accumulation.

Methods of making and using such detergent compositions are also provided. Another embodiment is a detergent composition including from about 20% to about 90% by weight of an alkali metal hydroxide between about 1% and about 30% by weight of a polycarboxylic acid copolymer, with a phosphorus group, and between about 0.1% and about 10% by weight of a nonionic surfactant. The composition may also optionally include from about from about 0% by weight to about 30% by weight of a chelant. The composition may also include from about 0% by weight to about 40% by weight of a detergent component selected from the group consisting of sodium gluconate, sodium carbonate, sodium chloride and sodium sulfate.

DETAILED DESCRIPTION OF THE INVENTION

The detergent compositions of the present invention include an alkali metal hydroxide, a nonionic surfactant and a polycarboxylic acid copolymer or salts thereof. In addition, the detergent compositions may be substantially free of phosphorous and NTA to meet certain regulatory standards. The compositions may be used for machine and manual warewashing, presoaks, laundry and textile cleaning and de-staining, carpet cleaning and de-staining, vehicle cleaning and care applications, surface cleaning and detaining, kitchen and bath cleaning and detaining, floor cleaning and detaining, cleaning in place operations, general purpose cleaning and detaining, industrial or household cleaners, and pest control agents. The composition may be in the form of a liquid concentrate, a use solution, a solid block, granules or a powder.

In aspects of the invention the detergent compositions are nitrilotriacetic acid (NTA)-free to meet certain regulations. In additional aspects of the invention the stability enhancement agent and the detergent compositions may be substantially phosphorous free to meet certain regulations. The polycarboxylic acid copolymer of the claimed invention may provide substantially phosphorous free detergent compositions having less than about 0.5 wt-% of phosphorus.

Source of Alkalinity

The detergent composition includes an effective amount of one or more alkaline sources to enhance cleaning and improve soil removal performance. The alkalinity source may constitute between about 20% and about 90% by weight, between about 30% and about 80% by weight, and between about 40% and about 70% by weight of the total weight of the detergent composition.

An effective amount of one or more alkaline sources should be considered as an amount that provides a use composition having a pH between about 10.5 and 13.

Examples of suitable alkaline sources of the detergent composition include, but are not limited to alkali metal hydroxides including, but not limited to sodium, or potassium hydroxide. The alkali metal hydroxide may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as, for example, a 45% and a 50% by weight solution. In one embodiment, the alkali metal hydroxide is added in the form of an aqueous solution, particularly a 50% by weight hydroxide solution, to reduce the amount of heat generated in the composition due to hydration of the solid alkali material.

In addition to the first alkalinity source, the detergent composition may comprise a secondary alkalinity source. Examples of useful secondary alkaline sources include, but are not limited to: metal carbonates such as sodium or potassium carbonate, bicarbonate, sesquicarbonate; metal borates such as sodium or potassium borate; and ethanolamines and amines. Such alkalinity agents are commonly available in either aqueous or powdered form, either of which is useful in formulating the present detergent compositions.

The detergent composition of the invention is substantially free of alkali metal silicates including sodium or potassium silicates having a weight ratio of $SiO_2$:$M_2O$ from about 1:1 to 4:1. Substantially free of alkali metal silicates means that the concentrated composition has less than 0.5% wt % and preferably less than 0.1 wt % of an alkali metal silicate based on the total weight of the concentrated composition.

The detergent composition may be phosphorus-free and/or nitrilotriacetic acid (NTA)-free to meet certain regulations. Phosphorus-free (also referred to as "free of phosphorous") means a concentrated composition having less than approximately 0.5 wt % based on the total weight of the concentrated composition. NTA-free (also referred to as "free of NTA") means a concentrated composition having less than approximately 0.5 wt %, less than approximately 0.1 wt %, and often less than approximately 0.01 wt % NTA based on the total weight of the concentrated composition.

Water Soluble Polymer, or Salt Thereof, with a Phosphonate Group

The detergent composition includes a water soluble polymer, namely a polycarboxylic acid polymer or salts thereof with a phosphorus end with the general structure:

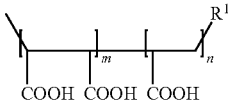

Wherein:

1.) The molecular weight is from about 1,000 to about 50,000 g/mol
2.) The ratio of m:n is from about 1:50 to about 2:5
3.) R1 is a phosphono (—P(=O)(OH)$_2$) or phosphino (—PH(=O)(OH)) end group
4.) The phosphino or phosphono end group comprises from about 0.1 wt % to about 12 wt % of the polycarboxylic acid copolymer Wherein the detergent composition is substantially free of alkali metal silicates.

The polymers, including the phosphorus end group may be present fully or partly in the neutralized form. The carboxylic acid functional groups and/or phosphorus end group in some or all phosphorus end groups may be exchanged for metal ions, preferably alkali metal ions such as sodium or potassium. It will be appreciated that compliance with the pH criterion has to be ensured.

The molar mass of the polymers can be varied in order to adjust the properties of the polymers to the desired end use. Preferred copolymers have molar masses of from 1,000 to 200,000 $gmol^{-1}$, preferably of from 1000 to 100,000 $gmol^{-1}$ and, in particular, of from 1,000 to 50,000 $gmol^{-1}$.

Suitable polyacrylic polymers or acrylic-maleic copolymers for use herein are available from Dow Chemical Company Midland, Mich. under the trade names ACUSOL® 425N. In one embodiment Acusol® 425N is utilized. Acusol® 425N is an acrylic-maleic (ratio 80/20) copolymer, having a molecular weight of 1,900. Another suitable polyacrylate polymer is YS-100 which is commercially available from Nippon Shokubai Co. Ltd.

The polycarboxylic acid copolymer, or salt thereof, with a phosphorus group can be present in an amount of from about 1 wt. % to 30 wt. % of the total detergent composition.

Non-Ionic Surfactant

The detergent composition also includes a nonionic surfactant at a level of from 0.1 wt. % to 10 wt. %, preferably from 0.1 wt. % to 8 wt. %, more preferably from 0.1 wt % to 5% by weight of total composition. Examples of nonionic surfactants useful in the detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va.

Chelant

The detergent composition can also optionally include a chelant at a level of from 0 wt. % to 30 wt. %, preferably from 0 wt. % to 20 wt. %, more preferably from 0 wt. % to 15 wt. % by weight of total composition. Chelation herein means the binding or complexation of a bi- or multidentate ligand. These ligands, which are often organic compounds, are called chelants, chelators, chelating agents, and/or sequestering agent. Chelating agents form multiple bonds with a single metal ion. Chelants are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant. The chelants for use in the present invention are those having crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinsed away and do not form a deposit.

Suitable chelating agents can be selected from the group consisting of amino carboxylates, amino phosphonates, polyfunctionally-substituted aromatic chelating agents and mixtures thereof. Preferred chelants for use herein are weak chelants such as the amino acids based chelants and preferably citrate, tararate, and glutamic-N,N-diacetic acid and derivatives and/or phosphonate based chelants and preferably diethylenetriamine penta methylphosphonic acid.

Amino carboxylates include ethylenediaminetetra-acetates, N-hydroxyethylethylenediaminetriacetates, nitrilotriacetates, ethylenediamine tetraproprionates, triethylenetetraaminehexacetates, diethylenetriaminepentaacetates, and ethanoldi-glycines, alkali metal, ammonium, and substituted ammonium salts therein and mixtures therein. As well as MGDA (methylglycine diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), serine-N,N-diacetic acid (SEDA), isoserine-N,N-diacetic acid (ISDA), phenylalanine-N,N-diacetic acid (PHDA), methylglycine diacetic acid (MGDA), glutamic acid-N,N-diacetic acid (GLDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

In another embodiment, the chelant may constitute between about 0 and about 25% by weight, between about 0.1% and about 20% by weight, and between about 1% and about 20% by weight of the total weight of the detergent composition.

Other chelants include homopolymers and copolymers of polycarboxylic acids and their partially or completely neutralized salts, monomeric polycarboxylic acids and hydroxycarboxylic acids and their salts. Preferred salts of the above-mentioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis(methylenephosphonates) as DEQUEST. Preferred, these amino phosphonates do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Further suitable polycarboxylates chelants for use herein include citric acid, lactic acid, acetic acid, succinic acid, formic acid all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Water

The detergent compositions according to the invention may comprise water in amounts that vary depending upon techniques for processing the composition.

Water provides a medium which dissolves, suspends, or carries the other components of the composition. Water can also function to deliver and wet the composition of the invention on an object.

In some embodiments, water makes up a large portion of the composition of the invention and may be the balance of the composition apart from source of alkalinity, phosphonopolycarboxylic acid, additional ingredients, and the like. The water amount and type will depend upon the nature of the composition as a whole, the environmental storage, and method of application including concentration composition, form of the composition, intended method of deliver, among other factors. Notably the carrier should be chosen and used at a concentration which does not inhibit the efficacy of the functional components in the composition of the invention for the intended use, e.g., bleaching, sanitizing, cleaning.

In certain embodiments, the present composition may include about 1 to about 90 wt-% water, about 1 to about 60 wt % water, about 1 to about 40 wt % water, or about 1 to about 20 wt % water. It is to be understood that all values and ranges between these values and ranges are encompassed by the present invention.

When preparing a solid detergent composition water may be present in the ranges of between about 0.01% and about 40% by weight, particularly between about 0.1% and about 35% by weight, and more particularly between about 1% and about 30% by weight.

Additional Functional Materials

The components of the detergent composition can be combined with various additional functional components. In some embodiments, the detergent composition including the alkalinity source and the polycarboxylic acid copolymer, and water make up a large amount, or even substantially all of the total weight of the detergent composition, for example, in embodiments having few or no additional functional materials disposed therein. In these embodiments, the component concentrations ranges provided above for the detergent composition are representative of the ranges of those same components in the detergent composition.

The functional materials provide desired properties and functionalities to the detergent composition. For the purpose of this application, the term "functional materials" includes a material that when dispersed or dissolved in a use and/or concentrate, such as an aqueous solution, provides a beneficial property in a particular use. Some particular examples of functional materials are discussed in more detail below, although the particular materials discussed are given by way of example only, and that a broad variety of other functional materials may be used. For example, many of the functional materials discussed below relate to materials used in cleaning and/or de-staining applications. However, other embodiments may include functional materials for use in other applications.

Additional Surfactants

The detergent composition can include an additional surfactant or surfactant system. A variety of surfactants can be used in the detergent composition, in addition to the non-ionic surfactant above including, but not limited to: anionic, an additional nonionic (supra), cationic, and zwitterionic surfactants. Surfactants are an optional component of the detergent composition and can be excluded from the concentrate. Exemplary surfactants that can be used are commercially available from a number of sources. For a discussion of surfactants, see Kirk-Othmer, Encyclopedia of Chemical Technology, Third Edition, volume 8, pages 900-912. When the detergent composition includes a cleaning agent, the cleaning agent is provided in an amount effective to provide a desired level of cleaning. The detergent composition, when provided as a concentrate, can include the cleaning agent in a range of about 0.05% to about 20% by weight, about 0.5% to about 15% by weight, about 1% to about 15% by weight, and about 1.5% to about 10% by weight. Additional exemplary ranges of surfactant in a concentrate include about 0.5% to about 8% by weight, and about 1% to about 5% by weight.

Examples of anionic surfactants useful in the detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of cationic surfactants that can be used in the detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the detergent composition include, but are not limited to: betaines, imidazolines, and propionates.

Because the detergent composition is intended to be used in an automatic dishwashing or warewashing machine, the surfactants selected, if any surfactant is used, can be those that provide an acceptable level of foaming when used inside a dishwashing or warewashing machine. Detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Builders

The detergent composition can include one or more building agents, also called chelating or sequestering agents (e.g., builders), including, but not limited to: a condensed phosphate, a phosphonate, an aminocarboxylic acid, or a polyacrylate. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the composition as water of hydration.

Examples of phosphonates include, but are not limited to: 2-phosphinobutane-1,2,4-tricarboxylic acid (PBTC), 1-hydroxyethane-1,1-diphosphonic acid, $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; and phosphorus acid, $H_3PO_3$. Preferred phosphonates are PBTC, HEDP, ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the composition is phosphorous-free.

The detergent compositions can contain a non-phosphorus based builder. Although various components may include trace amounts of phosphorous, carboxylates such as citrate, tartrate or gluconate are also suitable. Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers Hardening Agents The detergent compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid detergent composition during use.

The amount of hardening agent included in the detergent composition will vary according to factors including, but not limited to: the type of detergent composition being prepared, the ingredients of the detergent composition, the intended use of the composition, the quantity of dispensing solution applied to the solid composition over time during use, the temperature of the dispensing solution, the hardness of the dispensing solution, the physical size of the solid detergent composition, the concentration of the other ingredients, and the concentration of the cleaning agent in the composition. It is preferred that the amount of the hardening agent included in the solid detergent composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the solid detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of solid detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight.

Urea particles can also be employed as hardeners in the detergent compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid detergent composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the detergent composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight.

Fillers

The detergent composition can include an effective amount of detergent fillers which do not perform as a cleaning agent per se, but cooperates with the cleaning agent to enhance the overall cleaning capacity of the composition. Examples of detergent fillers suitable for use in the present compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the composition. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposition Agents

The detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight.

Stabilizing Agents

The detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

Dispersants

The detergent composition may also include dispersants. Examples of suitable dispersants that can be used in the detergent composition include, but are not limited to: maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in the detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 15% by weight, between approximately 0.5% to approximately 10% by weight, and between approximately 1% to approximately 5% by weight.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin.

Thickeners

The detergent compositions can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of xanthomonas campestras. Xanthan may be made by fermentation based on corn sugar or other corn sweetener byproducts. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN®XZ, available from Kelco Division of Merck, San Diego, Calif. Known organic crosslinking agents can also be used. A preferred crosslinked xanthan is KELZAN® AR, which provides a pseudo plastic use solution that can produce large particle size mist or aerosol when sprayed.

Methods of Use of the Compositions of the Invention

The compositions of the invention are further suitable for use in various applications and methods, including any application suitable for an alkaline detergent wherein the prevention of hard water scale accumulation on surfaces is desired. In addition, the methods of the invention are well suited for controlling spotting, filming and water hardness buildup on a plurality of surfaces. The methods of the invention prevent moderate to heavy accumulation of hardness and/or the redeposition of soils on treated substrate surfaces which beneficially improving the aesthetic appearance of the surface. In certain embodiments, surfaces in need of hard water scale accumulation prevention, include for example, plastics, metal and/or glass surfaces.

In a beneficial aspect of the invention, the methods of the invention reduce spotting, filming and the formation, precipitation and/or deposition of hard water scale, such as calcium carbonate, on hard surfaces contacted by the detergent compositions. In an embodiment, the detergent compositions are employed for the prevention of formation, precipitation and/or deposition of hard water scale on articles such as glasses, plates, silverware, etc. The detergent compositions of the invention may be in the form of a liquid, powder, paste or solid. Solid compositions include extruded, pressed or cast solids. The solid detergent compositions according to the invention beneficially provide such prevention of formation, precipitation and/or deposition of hard water scale despite the high alkalinity of the detergent composition use solutions in the presence of hard water. The detergent compositions are effective at preventing hard water scale accumulation and/or preventing the redeposition of soils in warewashing applications using a variety of water sources, including hard water. In addition, the detergent compositions are suitable for use at temperature ranges typically used in industrial warewashing applications, including for example from about 145° F. to about 180° F. during washing/rinsing steps.

In addition, the methods of use of the detergent compositions are also suitable for CIP and/or COP processes to replace the use of bulk detergents leaving hard water residues on treated surfaces. The methods of use may be desirable in additional applications where industrial standards are focused on the quality of the treated surface, such that the prevention of hard water scale accumulation provided by the detergent compositions of the invention are desirable. Such applications may include, but are not limited to, vehicle care, industrial, hospital and textile care.

Additional examples of applications of use for the detergent compositions include, for example, alkaline detergents effective as grill and oven cleaners, ware wash detergents, laundry detergents, laundry presoaks, drain cleaners, hard surface cleaners, surgical instrument cleaners, transportation vehicle cleaning, vehicle cleaners, dish wash presoaks, dish wash detergents, beverage machine cleaners, concrete cleaners, building exterior cleaners, metal cleaners, floor finish strippers, degreasers and burned-on soil removers. In a variety of these applications, cleaning compositions having a very high alkalinity are most desirable and efficacious, however the damage caused by hard water scale accumulation is undesirable.

Use Compositions

The compositions of the present invention include concentrate compositions and use compositions. For example, a concentrate composition can be diluted, for example with water, to form a use composition. In an embodiment, a concentrate composition can be diluted to a use solution before to application to an object. For reasons of economics, the concentrate can be marketed and an end user can dilute the concentrate with water or an aqueous diluent to a use solution.

The level of active components in the concentrate composition is dependent on the intended dilution factor and the desired activity of the hardness control composition. Generally, The concentrate composition can be diluted with water to form a use solution comprising from about 1,000 to about 40,000 ppm of the detergent concentrate. In some embodiments, higher use dilutions can be employed if elevated use temperature (greater than 25° C.) or extended exposure time (greater than 30 seconds) can be employed. In the typical use locus, the concentrate is diluted with a major proportion of water using commonly available tap or service water mixing the materials at a dilution ratio of about 0.5 to about 40 ounces of concentrate per 100 gallons of water.

In some embodiments, when used in a laundry application, the concentrated compositions can be diluted at a dilution ratio of about 0.1 g/L to about 100 g/L concentrate to diluent, about 0.5 g/L to about 50/L concentrate to diluent, about 1.0 g/L to about 30 g/L concentrate to diluent, or about 1.0 g/L to about 10.0 g/L concentrate to diluent.

The Warewashing Process

The inventive detergent compositions of the invention may be generally utilized in any of the conventional, domestic and institutional, warewashing machines.

Typical institutional warewashing processes are either continuous or non-continuous and are conducted in either a single-tank or a multi-tank/conveyor-type machine.

In the conveyor-type system prewash, wash, post-wash rinse and drying zones are generally established using partitions. Wash water is introduced into the post-wash rinsing zone and is passed cascade-fashion back toward the prewash zone while the dirty dishware is transported in a countercurrent direction. In an alternative (so called "by-pass") process, this rinse-water is introduced into the pre-wash zone. It may be attractive to combine this "by-pass" process with the method of the present invention, because in this way a pH-gradient is created over the wash tanks, which is likely to lead to more optimal conditions for soil removal. For instance, enzymes—when present in the first component—can become more active at the more neutral pH-conditions resulting from the introduction of acid post-wash rinse composition into the prewash zone. Various multi-tank warewashing machines have the option to rinse only when dishes are passed through the post-wash rinsing section. It can be attractive to combine this option with the method of the present invention, because in that way the volume of the acid rinse solution is limited. Such limited acid rinse volume will only have a limited effect as to its ability to reduce the alkalinity of the main wash solution.

Furthermore, each component of the cleaning system of the invention is applied in the warewashing machine using conventional means such as suitable spray nozzles or jets directed upwards and/or downwards toward the dishware.

The compositions of the invention may be added as a component of the alkaline detergent, or as a pre-wash or even post-wash treatment.

Formulating the Detergent Composition

The detergent composition can be formulated to handle the expected hard water level in a given environment. That is, the concentration of the composition in a cleaning composition or used alone can be adjusted depending upon several factors at the situs of use including, for example, water hardness level and food soil concentration In machine warewashing applications, a food soil concentration of about 25 grams per gallon or more is considered high, a concentration of about 15 to about 24 grams per gallon is considered medium, and a concentration of about 14 grams per gallon or less is considered low. Water hardness exhibiting 15 grains per gallon or more is considered high, about 6 to about 14 grains per gallon is considered medium, and about 5 grains per gallon or less is considered low.

Forming a Concentrate

The detergent composition may be made using a mixing process. The phosphonopolycarboxylic acid and source of alkalinity and other functional ingredients are mixed for an amount of time sufficient to form a final, homogeneous composition. In an exemplary embodiment, the components of the cleaning composition are mixed for approximately 10 minutes.

A solid cleaning composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the cleaning composition under the expected conditions of storage and use of the solid cleaning composition. In general, it is expected that the cleaning composition will remain a solid when provided at a temperature of up to about 100° F. or lower than about 125° F.

In certain embodiments, the solid cleaning composition is provided in the form of a multiple-use solid, such as, a block or a plurality of pellets, and can be repeatedly used to generate aqueous cleaning compositions for multiple washing cycles. In certain embodiments, the solid cleaning composition is provided as a solid having a mass of about 500 g to about 10 kg. In certain embodiments, a multiple-use form of the solid cleaning composition has a mass of about 1 to about 10 kg. In further embodiments, a multiple-use form of the solid cleaning composition has a mass of about 5 kg to about 8 kg. In other embodiments, a multiple-use form of the solid cleaning composition has a mass of about 500 g to about 1 kg.

The components can be mixed and extruded or cast to form a solid such as pellets, powders or blocks. Heat can be applied from an external source to facilitate processing of the mixture.

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 1,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the scale control component may be separate from the remainder of the warewash detergent. One or more premixes may be added to the mixture.

The ingredients are mixed to form a substantially homogeneous consistency wherein the ingredients are distributed substantially evenly throughout the mass. The mixture can be discharged from the mixing system through a die or other shaping means. The profiled extrudate can be divided into useful sizes with a controlled mass. The extruded solid can be packaged in film. The temperature of the mixture when discharged from the mixing system can be sufficiently low to enable the mixture to be cast or extruded directly into a packaging system without first cooling the mixture. The time between extrusion discharge and packaging can be adjusted to allow the hardening of the detergent block for better handling during further processing and packaging. The mixture at the point of discharge can be about 20-90° C., and about 25-55° C. The composition can be allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The solidification process may last from a few minutes to about six hours, depending, for example, on the size of the cast or extruded composition, the ingredients of the composition, the temperature of the composition, and other like factors. Preferably, the cast or extruded composition "sets up" or begins to harden to a solid form within about 1 minute to about 3 hours, preferably about 1 minute to about 2 hours, most preferably about 1 minute to about 1.0 hours minutes.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

In aspects of the invention employing packaged solid detergent compositions, the products may first require removal from any applicable packaging (e.g. film). Thereafter, according to certain methods of use, the compositions can be inserted directly into a dispensing apparatus and/or provided to a water source for cleaning according to the invention. Examples of such dispensing systems include for example U.S. Pat. Nos. 4,826,661, 4,690,305, 4,687,121, 4,426,362 and U.S. Pat. Nos. Re 32,763 and 32,818, the disclosures of which are incorporated by reference herein in its entirety. Ideally, a solid detergent composition is configured or produced to closely fit the particular shape(s) of a dispensing system in order to prevent the introduction and dispensing of an incorrect solid product into the apparatus of the present invention. The packaging receptacle or container may be rigid or flexible, and composed of any material suitable for containing the compositions produced according to the invention, as for example glass, metal, plastic film or sheet, cardboard, cardboard composites, paper, and the like. The composition is processed at around 150-170° F. and are generally cooled to 100-150° before packaging. so that processed mixture may be cast or extruded directly into the container or other packaging system without structurally damaging the material. As a result, a wider variety of materials may be used to manufacture the container than those used for compositions that processed and dispensed under molten conditions.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will erode a surface of the concentrate to provide a liquid concentrate that will be introduced into the dishwashing machine.

In certain embodiments, the detergent composition may be mixed with a water source prior to or at the point of use. In other embodiments, the detergent compositions do not require the formation of a use solution and/or further dilution and may be used without further dilution.

In aspects of the invention employing solid detergent compositions, a water source contacts the detergent composition to convert solid detergent compositions, particularly powders, into use solutions. Additional dispensing systems may also be utilized which are more suited for converting alternative solid detergents compositions into use solutions. The methods of the present invention include use of a variety of solid detergent compositions, including, for example, extruded blocks or "capsule" types of package.

In an aspect, a dispenser may be employed to spray water (e.g. in a spray pattern from a nozzle) to form a detergent use solution. For example, water may be sprayed toward an apparatus or other holding reservoir with the detergent composition, wherein the water reacts with the solid detergent composition to form the use solution. In certain embodiments of the methods of the invention, a use solution may be configured to drip downwardly due to gravity until the dissolved solution of the detergent composition is dispensed for use according to the invention. In an aspect, the use solution may be dispensed into a wash solution of a ware wash machine.

FORMULATIONS OF THE INVENTION

Use Formulations:

According to the invention, use formulations may be made according to the following:

| | Formulation | Preferred | More preferred |
|---|---|---|---|
| Alkalinity source | 100-22,000 ppm | 100-10,000 ppm | 100-5,000 ppm |
| phosphonate polycarboxylate Polymer | 5-6000 ppm | 10-3000 ppm | 10-1500 ppm |
| Optional Chelant | 0-12,000 ppm | 0-6,000 ppm | 0-2,000 ppm |
| non-ionic surfactant | 1-1500 ppm | 1-600 ppm | 1-500 ppm |

In a concentrate the invention includes the following amounts in percent by weight:

Concentrate Formulations:

| | Formulation | Preferred | More preferred |
|---|---|---|---|
| Alkalinity source | 20-90 | 30-80 | 40-70 |
| Phosphonate substituted water soluble polymer | 1-30 | 1-20 | 1-10 |
| Optional chelant | 0-30 | 0-20 | 0-15 |
| non-ionic surfactant | 0.1-10 | 0.1-8 | 0.1-5 |
| water | 0-50 | 0-40 | 0-30 |

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Formulations were made according to the tables below and tested in a 100 cycle experiment as described herein.

Film Accumulation Test

Each 100 cycle experiment was performed using a Hobart AM-15 industrial warewash machine at a concentration of 750 ppm and a water hardness of 17 grains per gallon.

The 100 cycle experiments were performed by placing 6 clean glasses and one Newport Plastic Tumbler in a Raburn rack (see figure below for arrangement) and placing the rack inside the dish machine.

| | | | | | |
|---|---|---|---|---|---|
| | | | | | G |
| | | | | G | |
| | | | G | | |
| | | G | | | |
| | | | | P | |
| G | | | | | |

At the beginning of each wash cycle, the appropriate amount of detergent composition to achieve the desired concentration was automatically dispensed into the warewash machine to maintain the initial detergent concentration. The glasses were dried overnight, and then the following numeric grades were assigned for film accumulation using a strong light source.

Film accumulation on the glasses was analyzed using a lightbox test. The lightbox test standardizes the evaluation of the glasses run in the 100 cycle test using an analytical method. The lightbox test is based on the use of an optical system including a photographic camera, a lightbox, a light source and a light meter. The system is controlled by a computer program (Spot Advance and Image Pro Plus).

After the 100 cycle test, each glass was placed on its side in the lightbox, and the intensity of the light source was adjusted to a predetermined value using a light meter. The conditions of the 100 cycle test were entered into the computer. A picture of the glass was taken with the camera and saved on the computer for analysis by the program. The picture was analyzed using the upper half of the glass in order to avoid the gradient of darkness on the film from the top of the glass to the bottom of the glass, based on the shape of the glass.

Generally, a lower lightbox rating indicates that more light was able to pass through the glass. Thus, the lower the lightbox rating, the more effective the composition was at preventing scaling on the surface of the glass.

Formulations

Acusol 425N is an Acrylic/Maleic Copolymer with a phosphono end group available from Dow Chemical Company Midland, Mich.

Pluronic N3 is an Ethylene Oxide/Propylene Oxide Copolymer available from BASF Mount Olive, N.J.

Trilon M is a 40% solution of MGDA-$Na_3$ 40% solution available from BASF Mount Olive, N.J.

Formulations for 100 Cycle Experiment

| RM | Control 1 | EX 1 | EX 2 | EX 3 | EX 4 |
|---|---|---|---|---|---|
| Sodium Hydroxide Bead | 75 | 75 | 75 | 75 | 75 |
| Water | 23.3 | 18.3 | 8.3 | 8.3 | 0 |
| Pluronic N3 | 1.7 | 1.7 | 1.7 | 1.7 | 1.7 |
| Acusol 425N, 50% | | 5 | 15 | 5 | 23.3 |
| Trilon M, 40% | | | | 10 | 0 |
| Total | 100 | 100 | 100 | 100 | 100 |

100 Cycle Results

| Formulation | Sum (glasses) | Plastic | Sum (total) |
|---|---|---|---|
| Control | 393210 | 65405 | 458615 |
| EX 1 | 386163 | 24768 | 410931 |
| EX 2 | 196511 | 27779 | 224290 |
| EX 3 | 339274 | 34846 | 374120 |
| EX 4 | 105283 | 40433 | 145716 |

The results show that detergents compositions comprising an acrylic/maleic copolymer with a phosphorus end groups were more effective for controlling hard water scale accumulation versus Control #1.

Example 2

Fifty Cycle Redeposition Experiment for Institutional Warewash Detergents

Apparatus and Materials:

1. Institutional machine hooked up to the appropriate water supply
2. Raburn glass rack
3. Libbey heat resistant glass tumblers, 10 oz.
4. Cambro Newport plastic tumblers
5. Sufficient detergent to complete the test
6. Hot Point Soil
7. Titrator and reagents to titrate alkalinity
8. Water hardness test kit Hot Point Soil A 50/50 combination of beef stew and hot point soil was used at 4000 ppm. The soil consisted of the following ingredients:

1.) 2 cans of Dinty Moore Beef Stew (1360 g)

2.) 1 large can of tomato sauce (822 g)

3.) 15.5 sticks of Blue Bonnet Margarine (1746 g) Powdered milk (436.4 g)

Clean Glasses were Placed in the Racks According to the Table Below:

| | | | | | | |
|---|---|---|---|---|---|---|
| | | | | | | $G_6$ |
| | | | | | $G_5$ | |
| | | | | $G_4$ | | |
| | | | $G_3$ | | | |
| | | $G_2$ | | | P | |
| $G_1$ | | | | | | |

Next 4000 ppm of hot point soil was added to the machine (accounting for volume of sump) and the 50 cycle test was begun. After each cycle, the appropriate amount of hot point soil was added to maintain a sump concentration of 4000 ppm. At the beginning of each wash cycle, the appropriate amount of detergent was automatically dispensed into the warewash machine to maintain the initial detergent concentration. Detergent concentration was controlled by conductivity. The glasses and tumblers were allowed to dry overnight and were then graded for spots and film accumulation. The glasses were stained with coomassie blue to determine protein residue.

Analyses of Results

| Rating | Spots | Film |
|---|---|---|
| 1 | No spots | No Film |
| 2 | Spots at random | 20% of surface covered in film |
| 3 | ¼ glass spotted | 40% of the surface covered in film |
| 4 | ½ glass spotted | 60% of the surface covered in film |
| 5 | Whole glass spotted | At least 80% of the surface covered in film |

| Formulations for 50 Cycle Experiment (active concentrations) | | |
|---|---|---|
| RM | Control 2 | EXP 5 |
| Sodium Hydroxide (50%) | 1368 ppm | 1368 ppm |
| Acusol 425N | | 50 ppm |

| 50 Cycle Results | | | | | | | | |
|---|---|---|---|---|---|---|---|---|
| | G1 | G2 | G3 | G4 | G5 | G6 | P | Sum |
| Spotting Results | | | | | | | | |
| Control | 2 | 2 | 3 | 3 | 2.5 | 2.5 | 1.5 | 16.5 |
| EX 5 | 1.5 | 2 | 1.5 | 1.5 | 1.5 | 1.5 | 1.5 | 11 |
| Filming Results | | | | | | | | |
| Control | 2 | 3.5 | 4.5 | 4.5 | 3.5 | 3 | 5 | 26 |
| EX 5 | 1 | 1 | 1.5 | 1 | 1 | 1 | 2.5 | 9 |

The results show that the detergent composition (EX 5) comprising an acrylic/maleic copolymer with a phosphorus end groups was more effective for reducing spotting and filming versus the control formulation.

What is claimed is:

1. A detergent composition comprising:

about 100 ppm to about 22,000 ppm of an alkali metal hydroxide;

about 1 ppm to about 1500 ppm of a nonionic surfactant; and about 10 ppm to about 6,000 ppm of at least one polycarboxylic acid copolymer or salt thereof with the following structure

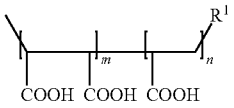

wherein:

a.) The molecular weight is from about 1,000 to 50,000 g/mol b.) The ratio of m:n is 1:50 to 2:5

R1 is a phosphino (i) or phosphono (ii) end group with the following structures i.)

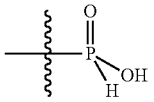

ii.)

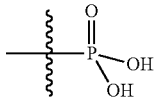

the phosphino or phosphono end group comprises from about 0.1 wt % to about 12 wt % of the polycarboxylic acid copolymer, wherein the detergent composition is substantially free of alkali metal silicates.

2. The detergent composition of claim 1 comprising from 100 to about 10,000 ppm of a source of alkali metal hydroxide, 1 to about 500 ppm nonionic surfactant and 10 to about 3000 ppm of at least one polycarboxylic acid copolymer or salt thereof.

3. The detergent composition of claim 2 wherein said nonionic surfactant includes one or more of the following: chlorine-capped polyethylene glycol ethers of fatty alcohols, alkyl-capped polyethylene glycol ethers of fatty alcohols, polyalkylene oxide free nonionic surfactants, sorbitan and sucrose esters and their ethoxylates, alkoxylated amines, alcohol alkoxylates, nonylphenol ethoxylate, polyoxyethylene glycol ether, carboxylic acid esters carboxylic amides, and polyalkylene oxide block copolymers.

4. The detergent composition of claim 3 wherein said nonionic surfactant is an ethylene oxide/propylene oxide copolymer.

5. The detergent composition of claim 1 further comprising a chelant selected from the group consisting of ethylenediamine tertaacetic acid (EDTA), hydroxyethylenediaminetetraacetic acid (HEDTA), diethylenetriaminepentaacetic acid (DTPA), methylglycinediacetic acid (MGDA), glutamic acid-N,N-diacetic acid (GLDA) and derivatives thereof.

6. The detergent composition of claim 5 wherein said chelant comprises up to about 12,000 ppm.

7. The detergent composition of claim 1 further comprising one or more of the components selected from the group consisting of sodium carbonate, sodium gluconate, sodium chloride and sodium sulfate.

8. An alkaline cleaning solution comprising from about 100 to about 10 000 ppm of an alkali metal hydroxide, 1 to about 600 ppm of a nonionic surfactant, and about 10 ppm to about 3000 ppm of a polycarboxylic copolymer or salt thereof with the following structure:

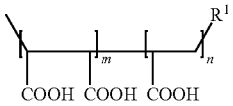

wherein:

a.) The molecular weight is from about 1,000 to 50,000 g/mol b.) The ratio of m:n is 1:50 to 2:5 c.) R1 is a phosphino (i) or phosphono end group (ii) with the following structures:

i.)

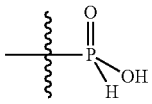

ii.)

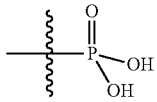

d.) The phosphino or phosphono end group comprises from about 0.1 wt % to about 12 wt % of the polycarboxylic acid copolymer, wherein the alkaline cleaning solution is prepared from a detergent composition that is substantially free of alkali metal silicates.

9. The alkaline cleaning solution of claim 8 further comprising a chelant selected from the group consisting of ethylenediamine tertaacetic acid (EDTA), hydroxyethylenediaminetetraacetic acid (HEDTA), diethylenetriaminepentaacetic acid (DTPA), methylglycinediacetic acid (MGDA), glutamic acid-N,N-diacetic acid (GLDA) and derivatives thereof.

10. The alkaline cleaning solution of claim 9 further comprising one or more of the following components selected from the group consisting of sodium carbonate, sodium gluconate, sodium chloride and sodium sulfate.

11. A method of reducing spotting, filming and hard water scale accumulation at application temperature of between 145-180 degrees Fahrenheit and with a pH of 10.5 to about 13 by contacting a substrate with a composition comprising:

about 100 ppm to about 22,000 ppm of an alkali metal hydroxide;

about 1 ppm to about 1500 ppm of a nonionic surfactant; and about 10 ppm to about 6,000 ppm of at least one polycarboxylic acid copolymer or salt thereof with the following structure:

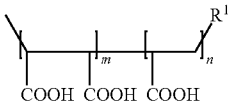

wherein:

a.) The molecular weight is from about 1,000 to 50,000 g/mol b.) The ratio of m:n is 1:50 to 2:5 c.) R1 is a phosphino (i) or phosphono (ii) end group with the following structures:

i.)

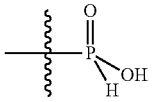

ii.)

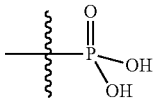

d.) The phosphino or phosphono end group comprises from about 0.1 wt % to about 12 wt % of the polycarboxylic acid copolymer, where in the detergent composition is substantially free of alkali metal silicates.

12. The method of claim 11 wherein the use solution comprises from about 100 ppm to about 10,000 ppm of a source of alkali metal hydroxide, about 1 ppm to about 600 ppm nonionic surfactant, and about 10 ppm to about 3000 ppm of at least one polycarboxylic acid copolymer or salt thereof.

13. The method of claim 11 wherein said nonionic surfactant includes one or more of the following: chlorine-capped polyethylene glycol ethers of fatty alcohols, alkyl-capped polyethylene glycol ethers of fatty alcohols, polyalkylene oxide free nonionic surfactants, sorbitan and sucrose esters and their ethoxylates, alkoxylated amines, alcohol alkoxylates, nonylphenol ethoxylate, polyoxyethylene glycol ether, carboxylic acid esters, carboxylic amides, and polyalkylene oxide block copolymers.

14. The method of claim 13 wherein said nonionic surfactant is an ethylene oxide/propylene oxide co-polymer.

15. The method of claim 11 wherein the detergent composition comprises a chelant selected from the group consisting of ethylenediamine tertaacetic acid (EDTA), hydroxyethylenediaminetetraacetic acid (HEDTA), diethylenetriaminepentaacetic acid (DTPA), methylglycinediacetic acid (MGDA), glutamic acid-N,N-diacetic acid (GLDA) and derivatives thereof.

16. The method of claim 11 wherein the detergent composition comprises one or more of the following components selected from the group consisting of sodium carbonate, sodium gluconate, sodium chloride and sodium sulfate.

17. The detergent composition of claim 3, wherein said alkyl-capped polyethylene glycol ethers of fatty acids are benzyl-, methyl-, propyl-, or butyl-capped; wherein said polyalkylene oxide free nonionic surfactants comprise alkyl polyglucosides; wherein said alkoxylated amines comprise alkoxylated ethylene diamine; wherein said alcohol alkoxylates comprise alcohol ethoxylate propoxylates, alcohol propoxylates, alcohol propoxylate ethoxylate propoxylates, or alcohol ethoxylate butoxylates; wherein said carboxylic acid esters comprise glycerol esters, polyoxyethylene esters, ethoxylated esters of fatty acids, or glycol esters of fatty acids; wherein said carboxylic amides comprise diethanolamine condensates, monoalkanolamine condensates, or polyoxyethylene fatty acid amides.

18. The method of claim 13, wherein said alkyl-capped polyethylene glycol ethers of fatty acids are benzyl-, methyl-, ethyl-, propyl-, or butyl-capped; wherein said polyalkylene oxide free nonionic surfactants comprise alkyl polyglucosides; wherein said alkoxylated amines comprise alkoxylated ethylene diamine; wherein said alcohol alkoxylates comprise alcohol ethoxylate propoxylates, alcohol propoxylates, alcohol propoxylate ethoxylate propoxylates, or alcohol ethoxylate butoxylates; wherein said carboxylic acid esters comprise glycerol esters, polyoxyethylene esters, ethoxylated esters of fatty acids, or glycol esters of fatty acids; wherein said carboxylic amides comprise diethanolamine condensates, monoalkanolamine condensates, or polyoxyethylene fatty acid amides.

* * * * *